US006991069B1

(12) United States Patent
Ach

(10) Patent No.: US 6,991,069 B1
(45) Date of Patent: Jan. 31, 2006

(54) CABLE ELEVATOR WITH A DRIVE PLATE

(75) Inventor: Ernst Ach, Ebikon (CH)

(73) Assignee: Inventio AG, (CH)

( * ) Notice: Subject to any disclaimer, the term of this patent is extended or adjusted under 35 U.S.C. 154(b) by 0 days.

(21) Appl. No.: 09/582,122

(22) PCT Filed: Dec. 11, 1998

(86) PCT No.: PCT/CH98/00533

§ 371 (c)(1),
(2), (4) Date: Jun. 22, 2000

(87) PCT Pub. No.: WO99/33742

PCT Pub. Date: Jul. 8, 1999

(30) Foreign Application Priority Data

Dec. 23, 1997 (EP) ..... 97811016

(51) Int. Cl.
*B66B 7/02* (2006.01)

(52) U.S. Cl. ..... 187/406; 187/254; 187/266; 187/409; 187/414

(58) Field of Classification Search ..... 187/254, 187/266, 406, 414, 409, 410
See application file for complete search history.

(56) References Cited

U.S. PATENT DOCUMENTS 1,125,133 A * 1/1915 Larsson ..... 187/254
4,664,230 A * 5/1987 Olsen
5,845,745 A * 12/1998 Lane ..... 187/406
5,899,300 A * 5/1999 Miller et al. ..... 187/266
5,899,301 A * 5/1999 Aulanko et al. ..... 187/254
5,944,144 A * 8/1999 Hein ..... 187/410 X
6,006,865 A * 12/1999 Ammon ..... 187/266
6,035,974 A * 3/2000 Richter et al. ..... 187/254

FOREIGN PATENT DOCUMENTS

| | | | | |
|---|---|---|---|---|
| DE | 39 22 798 | | 9/1990 | |
| EP | 0 686 594 | A2 | 12/1995 | |
| EP | 0 710 618 | A2 | 5/1996 | |
| JP | 353124843 | * | 10/1978 | ..... 187/254 |
| JP | 354040450 | * | 3/1979 | ..... 187/254 |
| JP | 4-50297 | | 11/1992 | |
| WO | 98/18709 | | 5/1998 | |

* cited by examiner

*Primary Examiner*—Steven B. McAllister
(74) *Attorney, Agent, or Firm*—Wolff & Samson PC; Klaus P. Stoffel

(57) ABSTRACT

A cable elevator includes a car which travels on first parallel guides and a counterweight which travels on second parallel guides, the guides being located in a respective first and second parallel planes. Drive machinery is arranged on an engine mount between the guides, the first guides extending upward past the mount, the second guides ending at the mount. Laterally spaced lower guide elements and laterally spaced upper guide elements are fixed to the car and engage the first guides. A support cable is fixed to the underside of the car so that the car can pass the drive machinery vertically.

12 Claims, 4 Drawing Sheets

CABLE ELEVATOR WITH A DRIVE PLATE

BACKGROUND OF THE INVENTION

1. Field of the Invention

The present invention relates to a cable elevator with drive pulley, consisting of a cage moving along at first separate guides, a counterweight moving along at second separate guides and a drive engine arranged in the shaft.

Such an elevator disposition needs no separate machine room, which gives lower plant costs and in addition offers the advantage of better utilisation of a building.

2. Discussion of the Prior Art

An elevator plant of the aforesaid kind is known from Japanese Utility Model publication No 50297/1992. Two columns in the form of two self-supporting U-section profile members serve as guides for the cage and for the counterweight. The two U-section profile members are closed off at the top by a crossbeam, which carries the drive engine. So that the rucksack cage can move to the height of the drive, the vertical part of the support frame of the cage extends only up to scarcely half the cage height, which produces a short vertical distance between the guide rollers. This results in a high loading for the guide rollers, even merely by the empty cage. So that the entire equipment does not tilt away from the wall, the crossbeam must additionally be firmly connected with the shaft rear wall, which loads this with corresponding large horizontal pulling forces. It is evident from the description that this elevator is usable or provided for stroke lengths of two to three storeys and low speeds and loads. The construction is not suitable for large elevators or installations with conventional drive components, as the U-shaped, one-piece double guide rails have to be provided disproportionately wide and heavy and specially processed.

SUMMARY OF THE INVENTION

The present invention is based on the object of creating an elevator without a machine room, the range of use of which elevator corresponds with that of conventional elevators with a separate machine room for residential buildings with, for example, up to 15 storeys and a conveying load up to 8 persons.

The invention is distinguished in that an engine mount together with the elevator drive is fastened to conventional guide pairs for the cage and the counterweight The vertical weight force of the drive, cage and counterweight is conducted to the shaft floor exclusively by way of the two guide rail pairs and is supported there. Thus, economic, conventional guide rails find use, wherein the guides of the cage and the counterweight can be of different lengths for optimisation of the guide element spacings at the cage. Added to that is the further advantage that in an ideal manner no bending moments act on the supporting guide rails by way of the drive, because through this kind of arrangement and fastening only vertical forces are exerted on the guide rails. Thus, an elevator without a machine room is realised, which can be equipped with only a new drive mount, but otherwise with conventional elevator components, even with respect to motor, brake, transmission and guide rail holders.

So that the cage with a normal rucksack support frame can travel to and beyond the height of the drive, the cage guides can extend beyond the engine mount still a bit further upwardly to approximately the shaft ceiling.

The introduction of the vertical force effects frictional coupling and mechanically positive coupling to both guide pairs, wherein the counterweight guides end, for example, within the engine mount.

A vibration-damped fastening of the engine mount to the guides can be produced with additional elements.

The support cables going away vertically downwards from the drive pulley are directly connected, without rollers for deflecting away or deflecting around, with the lower rear edge of the cage and with the upper side of the counterweight.

The fastening of the engine mount to the guides is effected by way of appropriately constructed end plates of the engine mount.

The fastening of the engine mount to the cage guides can advantageously take place at a butt joint location and thus replace connecting straps.

The engine mount is constructed as, for example, a simple welded construction and is composed of only two end plates, two connecting profile members and an engine bearer.

BRIEF DESCRIPTION OF THE DRAWINGS

The invention is more closely explained in the following on the basis of embodiments and illustrated in the drawings, in which.

DETAILED DESCRIPTION OF THE PREFERRED EMBODIMENTS

Figure 1:
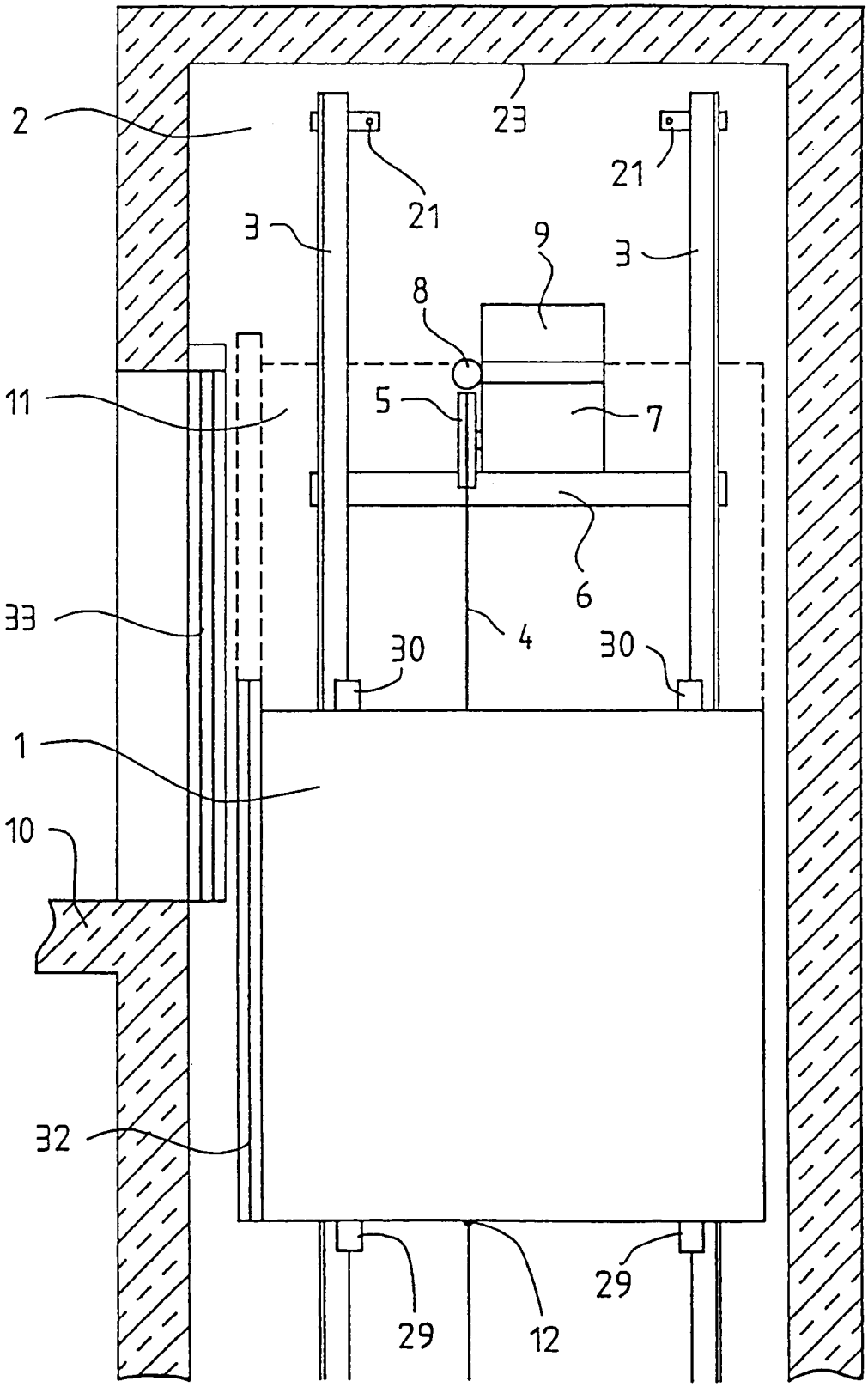
FIG. 1 shows a side view of the upper shaft region with cage, engine mount and drive.

The side view of FIG. 1 shows the upper part of a shaft 2 with the uppermost storey 10 and the shaft ceiling 23 closing off the shaft 2 at the top. A cage 1 is guided at cage guides 3 by means of upper and lower guide elements 29 30; and suspended at support cables 4, which are connected with the cage 1 at the rearward lower edge by way of a support cable fastening point 12. The support cable portions 4 below the cage 1 lead in the vertical plane to a counterweight 34 (FIG. 5), which is not visible here, to the upper part thereof, where they are connected with the counterweight 34. A cage door is designated by 32 and a storey door by 33. An engine mount 6 is fastened to the cage guides 3 and to counterweight guides 20 (FIG. 2), the latter not being visible in FIG. 1. A transmission 7 with a drive pulley 5 looped around by the support cables 4 is placed on the engine mount 6. A motor 9 and a brake 8 are arranged on the upper side of the transmission 7 and are operatively connected with the transmission 7. The cage guides 3 are fastened over the entire stroke length, and the counterweight guides 20 (FIG. 2), which are not visible here behind the cage guides 3, are fastened as far as under the engine mount 6, to a shaft wall at equal spacings. The outline 11 drawn in dashed lines shows the cage 1 at the position of the uppermost storey 10. In that case the cage 1 is already disposed at about the same height as the transmission 7.

The cage 1, however, still has available in addition an over-travel path of about one meter upwardly, which is possible thanks to the continuous cage guides 3 in the engine mount 6.

Figure 2:
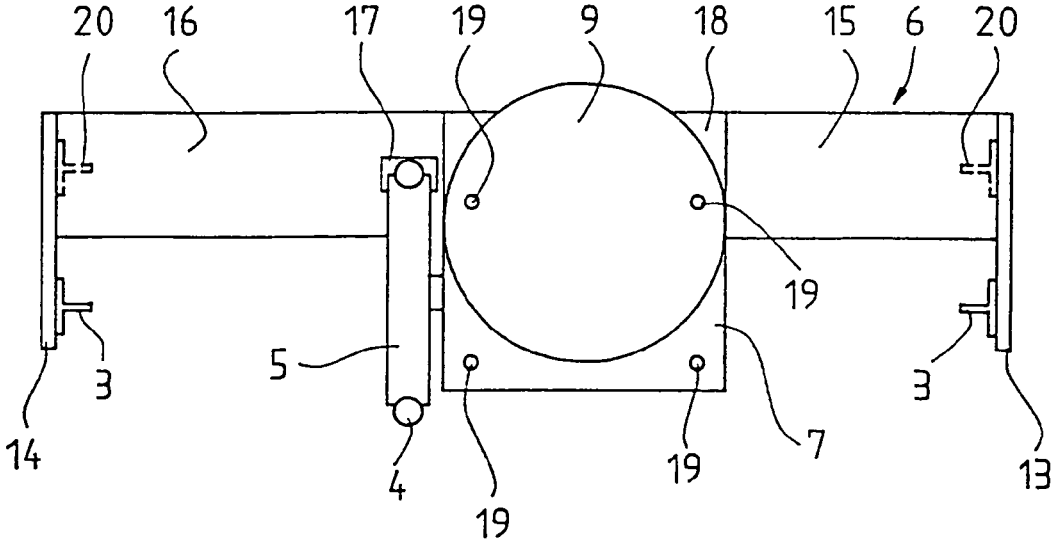
FIG. 2 shows a plan view of the engine mount.

The plan view of the engine mount 6 in FIG. 2 shows the details of this, preferably in a construction produced by welding technology. The engine mount 6 has end plates 14 and 13 respectively at the left and the right, which are welded at the lefthand end face to a longer square tube 16 and at the righthand end face to a shorter square tube 15. An engine bearer 18 is non-detachably connected in like manner, off-centre between the two end faces of the square tubes 15 and 16, with these end faces. A passage 17 for the support cable 4 is present in the square tube 16 at the left near the engine bearer 18. The roughly indicated transmission 7 is detachably fastened on the engine bearer 18 by means of the bores 19 and screws, which are not shown. Equally, the position of the drive pulley 5 with the support cables 4 is indicated, wherein it is apparent that the support cables 4 lead downwardly to the cage 1 and to the counterweight 34 (FIG. 4) without diagonal pull. It is further apparent that the engine mount 6 is fastened not only to the cage guides 3, but also the counterweight guides 20 and that the counterweight guides 20 end below the square tubes 15 and 16.

Figure 3:
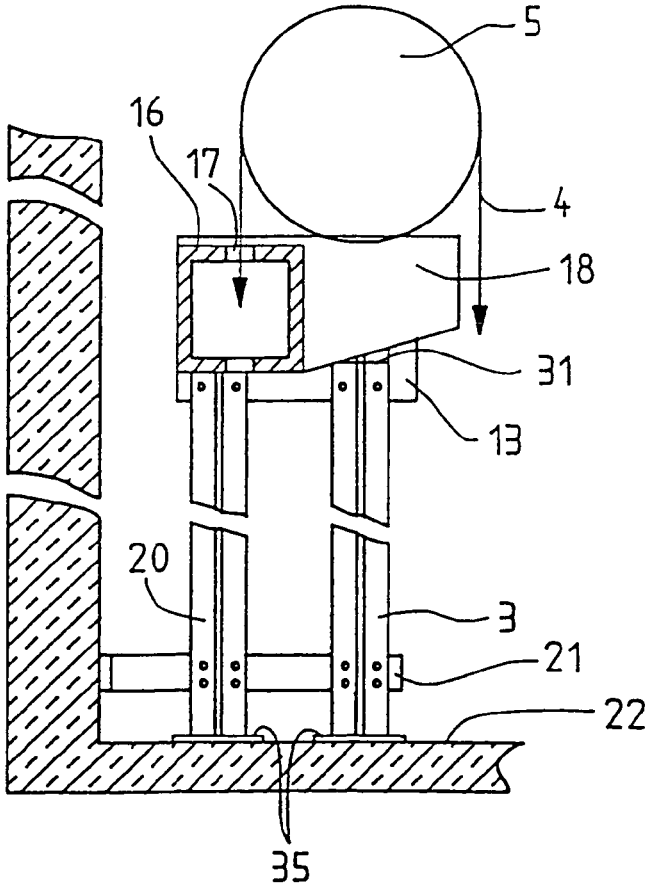
FIG. 3 shows a cross-section through the engine mount.

The shapes and proportions of the parts used for the engine mount 6 are apparent in FIG. 3 as a cross-section through the plane of the passage 17. Thus, for example, it can be established that the upper end of a first counterweight guide 20 abuts the underside of the square tube 15/16. Equally, the underside of the square tube 15/16 serves, although not apparent here, as vertical abutment for the second counterweight guide 20. Further, it can be shown that the end plates 13 and 14, here as example the end plate 13, serve at the same time as connecting strap for a butt joint location 31 of the cage guide 3. As already mentioned earlier, the vertical weight forces of the cage 1 (FIG. 5), the counterweight 34 (FIG. 5) and the drive are supported on the shaft floor 22 by way of the two guide rail pairs 3 and 20. The guide rails 3 and 20 can be set down on large-area foot plates 35 for the purpose of reducing the specific loading of the shaft floor 22. The guide holders 21, which are mounted at uniform spacings, serve not only for maintaining the guide geometry, but equally guarantee a sufficient buckling resistance of the guides 3 and 20 in the case of this, otherwise not usual, vertical loading.

Figure 4:
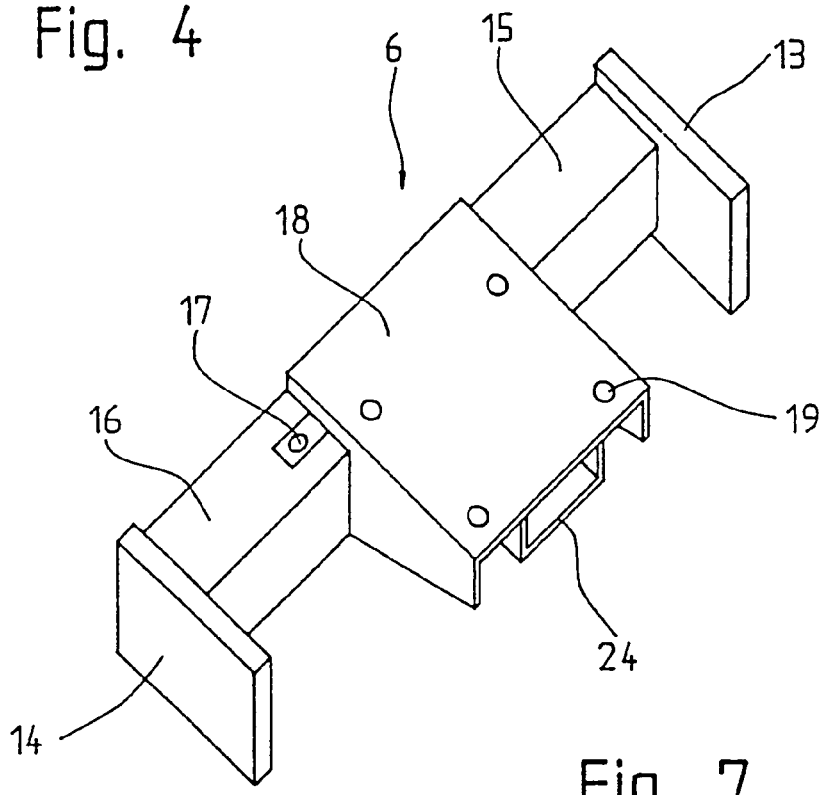
FIG. 4 shows a three-dimensional illustration of the engine mount.

The three-dimensional illustration in FIG. 4 shows the entire engine mount 6 in its physical form. As an additional feature, up to now not yet shown, only the optional reinforcement 24 under the surface of the engine bearer 18 is to be mentioned here.

Figure 5:
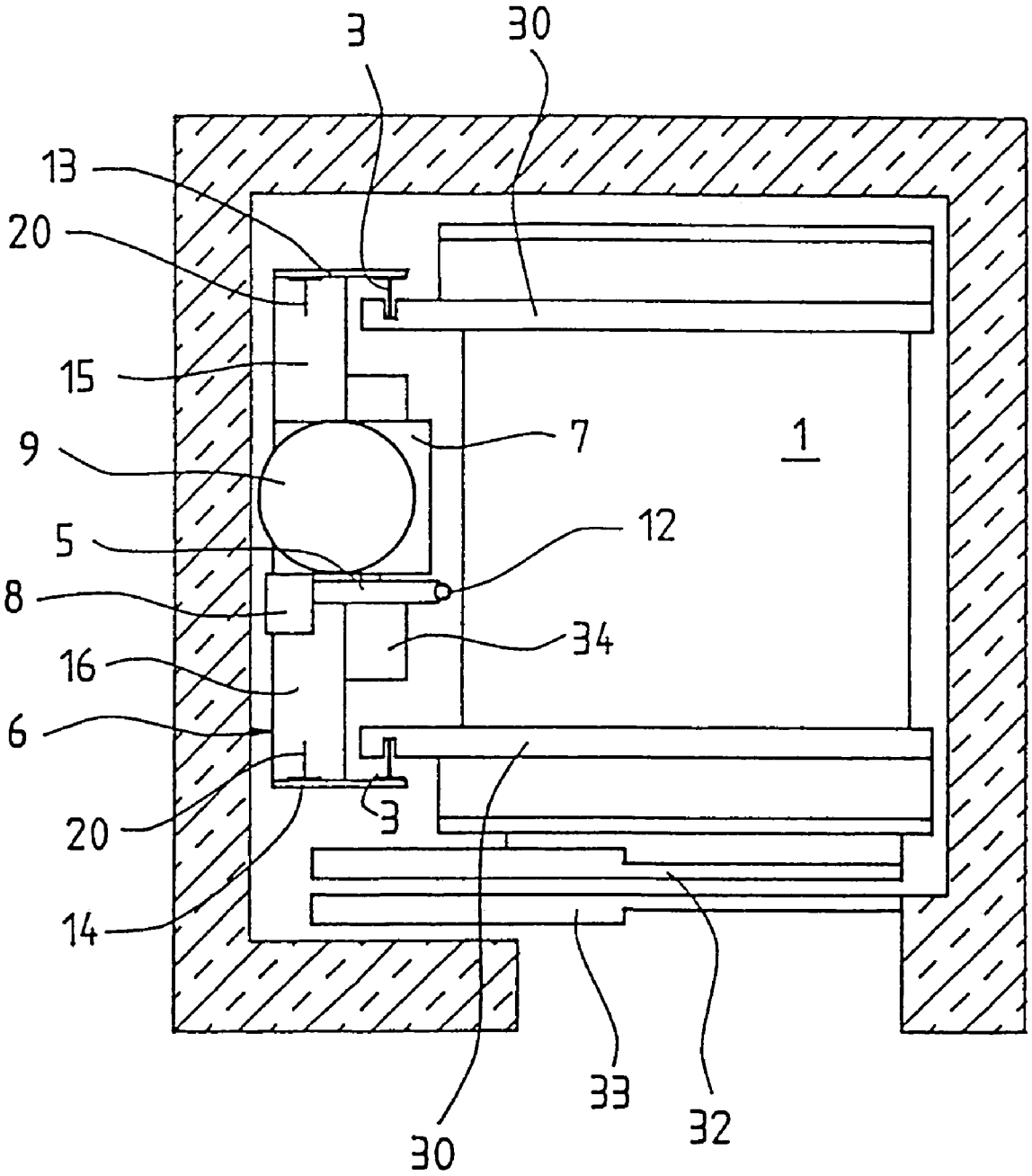
FIG. 5 shows a plan view of the cage, the drive and partially of the counterweight.

The invention as a whole is more closely explained in the following by reference to FIG. 5 with the plan view of all components. Due to the rucksack arrangement of the cage 1, the upper guide elements 30 and the lower guide elements 29 are disposed laterally spaced. The resulting space between the lower guide elements 29 and between the upper guide elements 30 is used for the now partly visible counterweight 34 and the drive subassembly with the engine mount 6. The rail holders 21 were omitted from view in this representation in order to show that the drive subassembly with the motor 9, the brake 8, the transmission 7 with the drive pulley 5 and the engine mount 6 have no kind of mechanical connection with any one shaft part. Also omitted was the speed limiter, which is placed on, for example, the square tube 15/16. The support cable fastening point 12 is displaced somewhat in the direction of the cage door 32 with respect to the centre between the cage guides 9 and with consideration of the asymmetrical weight distribution (door and door drive) of the cage 1. A control box, equally not illustrated, can be placed wherever desired. Various possibilities are offered for that purpose. Thus, this can be arranged by corresponding fastening elements, for example, similarly on the engine mount 6.

Figure 6:
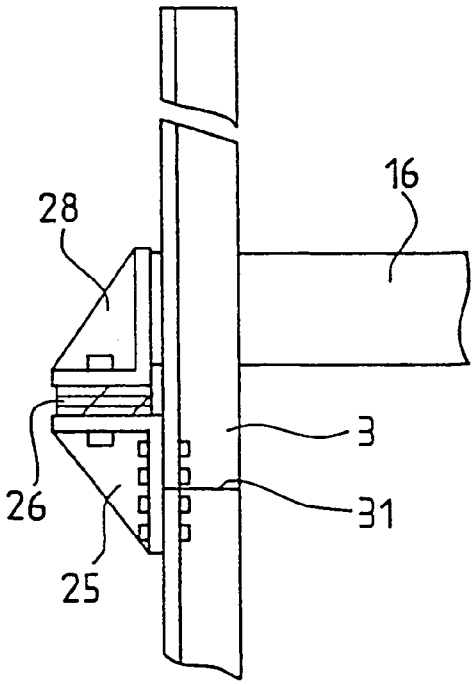
FIG. 6 shows a detail of the vibration damping at the cage guide.
Figure 7:
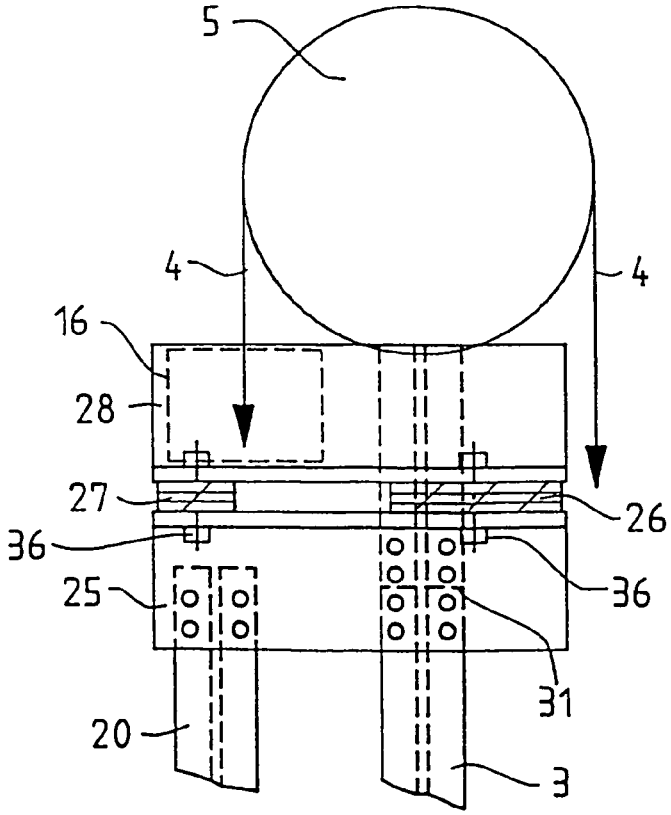
FIG. 7 shows a side view with the vibration damping at both guides.

For the purpose of insulation of body sound, the engine mount 6 can optionally be fastened to the guide rails 3 and 20 in vibration-damped manner. Such a vibration damping between the engine mount 6 and the guides 3 and 20 is provided for higher speeds and demands on comfort. One possible solution for a vibration-damped mounting is illustrated in FIGS. 6 and 7 by way of example. For this purpose, new and, in part, changed parts are provided for the engine mount. Instead of the flat end plates 13 and 14 a lefthand and a righthand side bracket 28 are used, the vertical sides of which are non-detachably connected, analogously to the end plates 13 and 14, firmly with the square tubes 15 and 16. A righthand and lefthand fastening bracket 25 are screw-connected to the guide rails 3 and 20 in the same way as the end plates 15 and 16 by direct fastening. For the actual vibration damping, a larger damping element 26 for the cage guide 3 and a smaller damping element 27 for the counterweight guide 20 are placed between the horizontal support surfaces of the two side brackets 28 and fastening brackets 25. Centring pins 36 prevent, without transmission of body sound, a lateral displacement of the engine mount by possible vibrations during operation. Forces laterally engaging the engine mount 6 are not present, because, due to the weight of the drive and the load suspended by way of the support cables 4 without deflecting rollers, exclusively vertical forces act on the engine mount 6. The area, thickness and resilience of the damping elements 26 and 27 is matched to the specific loads prevailing at these locations.

The construction of the engine mount 6 is not limited, with respect to choice of profile member and joining technique, to the kind of the shown example. A construction with other profile shapes would also be possible for that purpose and the connections of the parts amongst one another could also be made by means of screw connections.

With respect to the motor 9 and the transmission 7, any variant can be used for the drive of this elevator without an engine room, subject to be able to be arranged in the available space of this drive disposition. Due to the available surface area for the drive on the engine mount 6, a motor 9 is advantageously arranged in an upright position. Equally, also a motor with an integrated or attached coaxial transmission and brake and with a drive pulley going off at one side or two drive pulleys going off at both sides could be provided on the kind and arrangement of the engine mount 6 according to the invention, with appropriate adaptation of constructional details of the same.

The invention is not limited by the embodiments described above which are presented as examples only but can be modified in various ways within the scope of protection defined by the appended patent claims.

What is claimed is:

1. A cable elevator, comprising: an elevator shaft; first parallel guides arranged in a first vertical plane; second parallel guides separate from the first parallel guides and arranged in a second vertical plane parallel to and spaced from the first vertical plane, the first and the second guides being discontinuously connected in vertical and horizontal directions of the guides; a cage movably arranged on the first guides; a counterweight movably arranged on the second guides; an engine mount fastened to the first guides and to the second guides; a drive engine arranged on the engine mount, said first guides, said second guides, said engine mount and said drive engine being arranged in the elevator shaft, the first guides being connected to and extending upwardly beyond the engine mount; and a pair of guide elements fixed to said cage and engaged to said first parallel guides so that the guide elements are movable along the first parallel guides above and below the engine mount, the engine mount being arranged so that a vertical movement of the counterweight is restricted to a path below the engine mount.

2. A cable elevator according to claim 1, wherein the second guides are connected with the engine mount so as to end within it.

3. A cable elevator according to claim 1, wherein the drive engine includes a drive pulley, said elevator further comprising support cables that lead from the drive pulley directly to a support cable fastening point at an underside of the cage and directly to an upper side of the counterweight.

4. A cable elevator according to claim 1, further comprising means for connecting the engine mount with the guides of the cage and the guides of the counterweight in a vibration-damped manner.

5. A cable elevator according to claim 1, wherein the engine mount comprises end plates for fastening to the guide rails and an engine bearer, the end plates and the engine bearer being non-detachably fixedly interconnected.

6. A cable elevator according to claim 5, wherein the end plates of the engine mount form a butt joint connection for the guide rails of the cage.

7. A cable elevator according to claim 4, wherein the connecting means includes a fastening bracket that forms a butt joint connection for the guide rails of the cage.

8. A cable elevator as in claim 1, wherein said first guides comprise mutually facing inner sides and mutually opposed outer sides, said engine mount being fixed to one of said inner sides and said outer sides.

9. A cable elevator as in claim 8, wherein said engine mount is fixed to said mutually opposed outer sides.

10. A cable elevator as in claim 1, further comprising a pair of laterally spaced lower guide elements fixed to said cage and a pair of laterally spaced upper guide elements fixed to said cage, each pair of guide elements extending beyond said cage and engaging said first guides.

11. A cable elevator as in claim 10, wherein said first guides extend upward beyond said engine mount and accommodate at least one of said counterweight and said drive engine therebetween, said lower and upper guide elements forming a space therebetween which permits said cage to move vertically past said at least one of said counterweight and said drive engine.

12. A cable elevator according to claim 1, wherein said cage has guide followers located substantially at the top of the cage and the bottom of the cage, the cage being capable of vertical movement on the first parallel guides above and below the engine mount.

* * * * *